US005350096A

United States Patent [19]

Sieber

[11] Patent Number: 5,350,096

[45] Date of Patent: Sep. 27, 1994

[54] SKI CARRIER

[75] Inventor: L. Aryn Sieber, Rowland Heights, Calif.

[73] Assignee: Advanced Pro-Formance, Inc., Rowland Heights, Calif.

[21] Appl. No.: 893,283

[22] Filed: Jun. 3, 1992

[51] Int. Cl.[5] ..... A45F 3/04

[52] U.S. Cl. ..... 224/209; 224/208; 224/258; 224/259; 224/250; 224/917; 224/151; 224/153; 294/147

[58] Field of Search ..... 224/257, 258, 259, 202, 224/208, 209, 917, 250, 150, 151, 153; 294/147, 157

[56] References Cited

U.S. PATENT DOCUMENTS

| | | | |
|---|---|---|---|
| 4,114,838 | 9/1978 | Knauf | 224/917 |
| 4,760,944 | 8/1988 | Hughes | 224/916 |
| 4,792,073 | 12/1988 | Jacober | 224/257 |
| 4,911,347 | 3/1990 | Wilhite | 224/258 |

*Primary Examiner*—Linda J. Sholl

*Attorney, Agent, or Firm*—Knobbe, Martens, Olson & Bear

[57] ABSTRACT

A ski carrying device enables a skier to carry his or her skis and ski poles on the skier's back thereby freeing the skier's hand. The ski carrying device includes an upper cover and a lower cover. The skier wraps the upper and lower covers around the toe bindings and the heel bindings of the skis, respectively, with the skis positioned in a bottom-to-bottom arrangement. Each cover includes a strap which the skier wraps around the ski poles to hold the ski poles against the skis. The carrying device further includes a pair of shoulder straps, each strap connected to and extended between the upper cover and the lower cover. The skier places the straps over his or her shoulders to support the skis on the skier's back. In this position, the skier easily carries the skies and poles without using his or her hands. Furthermore, the skis worn on the skier's back are less likely to strike other persons or objects. The skier can also quickly compact the ski carrying device into a carrying pouch which the skier can unobtrusively wear around his or her waste when skiing.

17 Claims, 6 Drawing Sheets

SKI CARRIER

BACKGROUND OF THE INVENTION

1. Field of the Invention

The present invention relates generally to snow skiing equipment, and more particularly to ski equipment carrying devices.

2. Description of Related Art

Millions of people in the United States and throughout the world currently enjoy snow skiing. The sport's popularity in recent years, however, has overcrowded many ski resorts and facilities. Such crowds not only frustrate skiers on the slopes, but also pose problems to skiers off the slopes.

Large crowds increase the possibility of ski equipment theft when skiers wonder away from their equipment to eat or rest. Although the skier would like to keep his or her equipment close at hand, the cumbersome and awkward nature of the equipment prohibits the skier from carrying the equipment with him or her when eating, buying lift tickets or resting in a lounge or on a patio. Thus, the skier must leave the equipment in a common area, such as against a wall of the lodge, and hope that no one steals his or her skis.

In addition, when the skier props his or her skis between a wall and a cement or asphalt pathway, as skiers commonly do, the skier generally chips or dings the edges and tails of the skis. Many skiers also unstably position their skis against such structures, and the skis consequently fall, further damaging the skis.

Large crowds also present obstacles for skiers carrying their skis through the crowd. Skis typically range from 150 to 210 centimeters (cm) in length for adult sizes and are difficult to maneuver due to their length. Many skiers find the task of transporting their skis through a crowd of skiers additionally frustrating and many people or objects are struck by errantly directed ends of skis or ski poles.

Moreover, many adventurous skiers prefer to ski less crowded terrains off official ski runs. To reach these locations, adventurous skier often times must hike up slippery slopes or over rocky terrain to reach a desired location. Most skiers have difficulty traversing such terrain with their hands holding their ski poles and skis. These skiers commonly use the ends of skis and ski poles as canes to support themselves as they hike; consequently, the skiers damage their ski equipment. Further, many skier slip and fall without the use of their hands during the sometimes treacherous journey to the desired slope.

Prior ski toting devices do not enable skiers to easily transport their ski equipment through crowds or over rough terrain. In addition, the prior ski toting devices require the skier to use at least one hand, either to hold the device or to maintain a shoulder strap on the shoulder of the skier. The prior devices further do not easily and quickly attach to the skis and poles, and are not easily and unobtrusively carried by the skis. Furthermore, these devices are not easily stored when skiing.

SUMMARY OF THE INVENTION

One aspect of the present invention provides a ski carrying device for carrying a pair of skis on a skier's body. Thus, the skier can transport his or her ski equipment without occupying his or her hands, letting the skier use his or her hands to support the skier when traversing treacherous terrain or when eating or buying lift tickets. In addition, the skier does not have to set the skis on the ground to free his or her hands, thus reducing the possibility of damaging the skis. Furthermore, the skier is less likely to strike other skiers or objects with his or her skis when the skis are supported in a generally vertical on the skier's body.

The carrying device in accordance with one embodiment of the present invention includes a harness, such as a cover, configured to surround the skis proximate to the ski's bindings with the bottom surfaces of the skis juxtaposed. The harness including means for securing the harness to the skis. The carrying device additionally includes a pair of straps which allows the skier to carry the skis. The straps connecting to the harness such that the skier either can wear both straps over the skier's shoulders or can wear one strap over the shoulder and the other strap around the skier's waist.

In another preferred embodiment of the present invention, the ski carrying device includes an upper cover configured to encompass a pair of ski toe bindings with the bottoms of the skis juxtaposed. The upper cover also including a fastener to secure the upper cover to the skis. The carrying device further includes a lower cover configured to encompass a pair of ski heel binding. The lower cover also includes a fastener for securing the lower cover to the skis. A strap connects between the covers and allows the skier to carry the skis. The strap is desirably positioned such that with the strap worn over the skier's shoulder, the skier can positioned the skis generally vertically in an unobtrusive position.

In a preferred embodiment the carrying device includes a pair of straps worn by the skier to support the skis on the skier's back. In addition, the carrying device includes at one retention strap to secure a pair of ski poles to the carrying device.

In accordance with another aspect of the present invention, a ski carrying device includes an upper cover and a lower cover. The lower cover is configured to fold into a pouch having a sufficient size to receive the upper cover. The upper and lower covers form a compact bundle for storage with the upper cover inserted into the pouch formed by the lower cover. The ski carrying device additionally includes a strap which is removably connected to the upper cover and the lower cover such that the strap functions as a shoulder strap with the strap connected to the upper and lower covers. The strap also functions as a waist band with the strap connected to the lower cover at both ends of the strap.

In accordance with a preferred method of carrying skis in an unobtrusive position upon a skier's body, the method involves juxtaposing the bottom surfaces of the skis such that the corresponding sections of the bindings interconnect. A skier then wraps an upper cover around the toe bindings of the skis and secures the upper cover to the skis. The skier also wraps a lower cover around the heel bindings of the skis and secures the lower cover to the skis. The skier then attaches a pair of carrying straps to the upper cover and to the lower cover and pulls the straps over the skier's shoulders with the skis resting against the skier's back. When wearing the carrying device, the skier positions the skis in a generally vertical, unobtrusive position.

In a preferred method, the skier also compacts the carrying device to a small compact pouch. The skier first removes the ski carrying device from the skis. Thereafter, the skier inserts one side portion of the lower cover into an opposing side portion of the lower cover to compact the lower cover and form a pouch. The skier then inserts the upper cover and one of the straps into the pouch formed by the lower cover. With the carrying device configured in a small bundle, the skier positions the lower cover pouch at his or her waist, and attaches the compacted lower cover around the waist using one of the straps.

BRIEF DESCRIPTION OF THE DRAWINGS

These and other features of the invention will now be described with reference to drawings of a preferred embodiment with is intended to illustrate and not to limit the invention, and in which.

DETAILED DESCRIPTION OF THE PREFERRED EMBODIMENT

Figure 1:
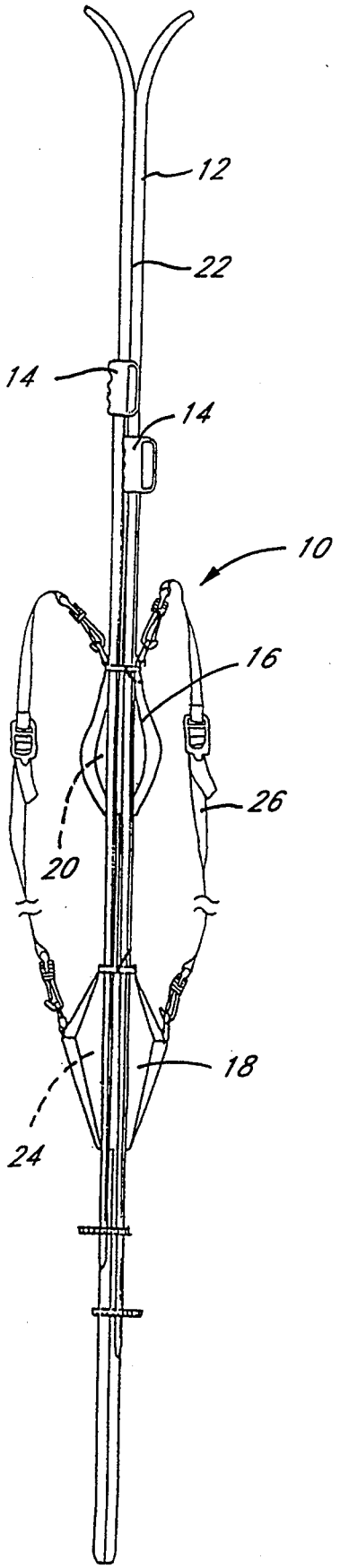
FIG. 1 is a side elevational view of a ski carrying device in accordance with the present invention secured to a pair of skis.
Figure 2:
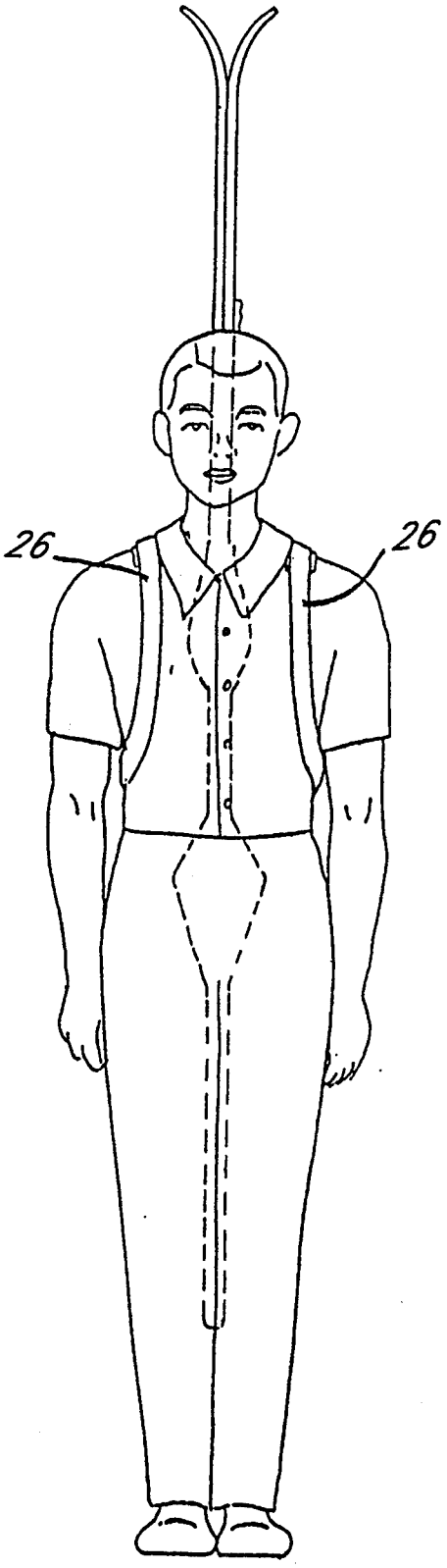
FIG. 2 is a side elevation view of a skier wearing the carrying device of FIG. 1 with carrying straps positioned over both shoulders of the skier.
Figure 3:
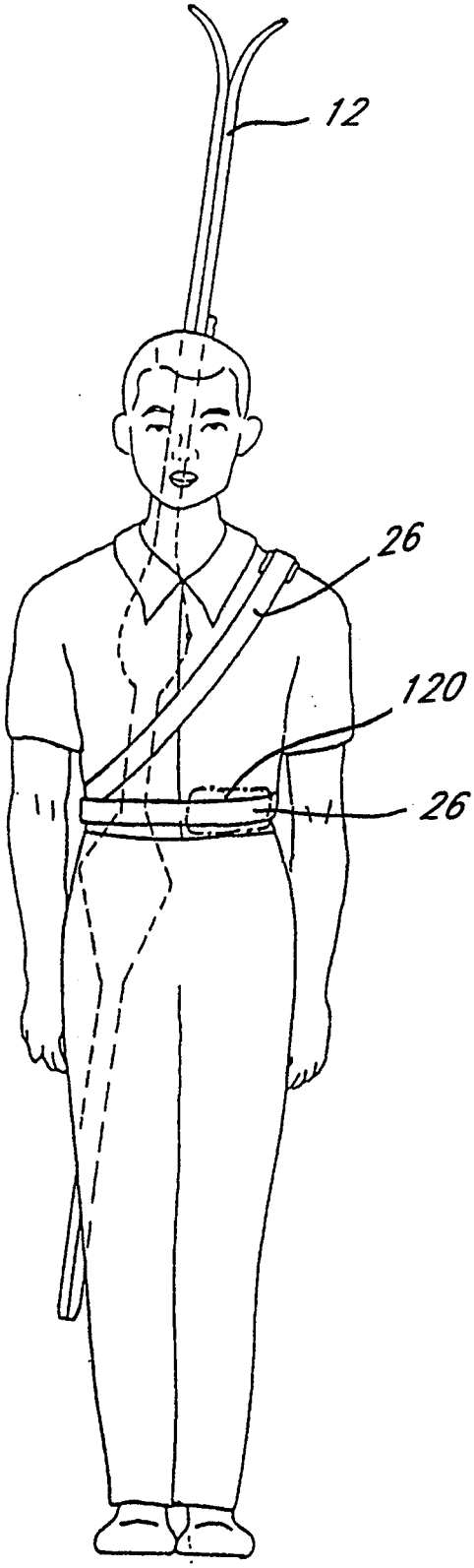
FIG. 3 is a side elevational view of a skier wearing the carrying device of FIG. 1 with one carrying strap positioned over one shoulder and the other carrying strap positioned around the skier's waist.

FIG. 1 illustrates a ski carrying device 10 configured in accordance with a preferred embodiment of the present invention. The carrying device 10 is designed to hold a pair of skis 12 together and is designed for a skier to wear over his or her shoulders to support the skis 12 on the skier's back. FIGS. 2 and 3 illustrate two alternative ways which a skier could wear the carrying device 10 described below. In both postures, the skier supports the skis 12 in a generally vertical position to reduce the obstructiveness of the skis 12. In addition, the carrying devices 10 enables the skier to carry the skis 12 and ski poles 14 without occupying the skier's hands.

Although the figures illustrate the present invention used in connection with snow skiing equipment, it is contemplated that the present invention could be used to carry other types or recreational articles, such as, for example, snowboards, water skis, surfboards, skateboards and like articles. Thus, the present description is intended only to illustrate one form which the invention could take. It is contemplated that those skilled in the art could readily adapt the present invention to carry other types of recreational articles to achieve the advantages of the present invention.

The carrying device 10 includes a cover which surrounds the bindings of the skis 12. As FIG. 1 illustrates, the carrying device 10 preferably comprises an upper cover 16 and a lower cover 18 to surround the corresponding portions of the ski bindings. The upper cover 16 is configured to snugly encompass the toe bindings 20 of the skis 12 when the bottom surfaces 22 of the skis 12 are juxtaposed in a manner interconnecting the binding brakes (not shown), as known in the art. Likewise, the lower cover 18 is configured to snugly encompass the heel bindings 24 of the skis 12 with the ski bottoms 22 juxtaposed.

The carrying device 10 also includes at least one carrying strap 26 which the skier wears over his or her shoulder. The carrying device 10 desirably includes a pair of straps 26. To wear the carrying device 10 as shown in FIG. 2, both straps 26 attach to and extend between both the upper cover 16 and lower cover 18. To wear the ski carrying device 10 as shown in FIG. 3, one strap 26 attaches to and extends between the upper cover 16 and lower cover 18; the second strap 26 only attaches to the lower cover 18 and extends around the skier's waist. Those skilled in the art will also appreciate that a skier could wear the carrying device 10 in a variety of ways in addition to those described herein and that the carrying device 10 could include additional straps.

The individual components of the carrying device 10 will now be described in detail.

Upper Cover

Figure 4:
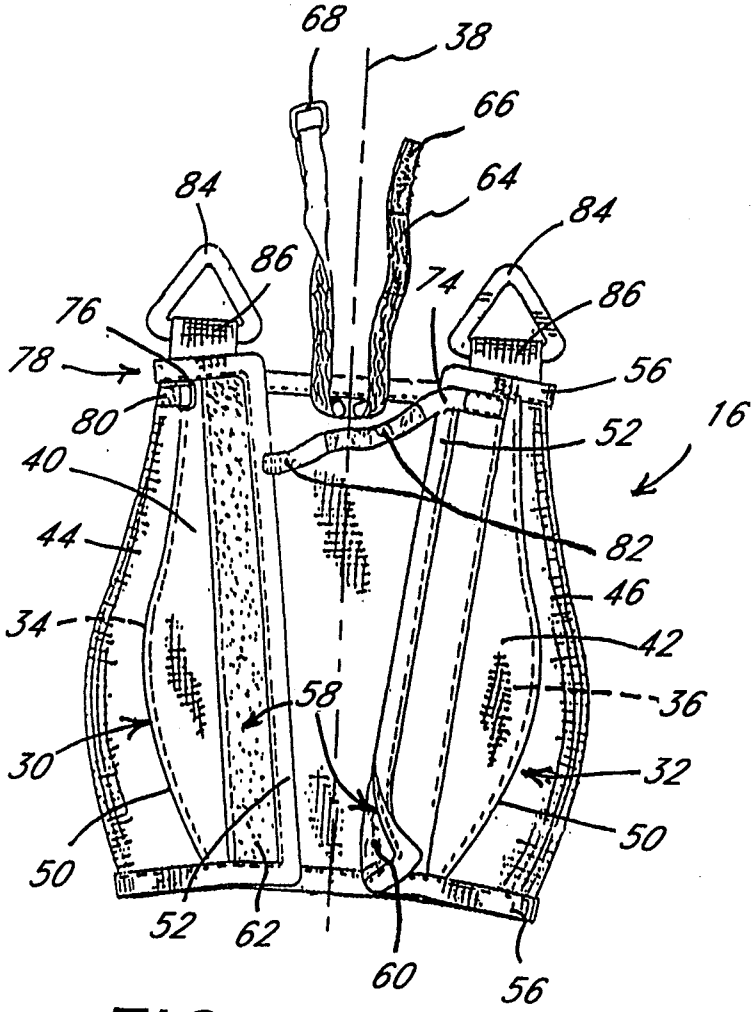
FIG. 4 is a front elevational view of an upper cover of the carrying device of FIG. 1.

FIG. 4 illustrates the upper cover 16 from a front side elevational view. The upper cover 16 is formed between a pair of mirror-image halves 30, 32, each of which define a pocket 34, 36 of sufficient size to receive a conventional toe binding 20 of the ski 12 to which the skier attaches the upper cover 16. However, those skilled in the art could readily customize the pockets 34, 36 defined by the upper cover 16 for any size bindings, such as, for example, larger ski racing bindings. The halves 34, 36 are desirably coupled together in a position placing the pockets 34, 36 in opposition. That is, the two halves 30, 32 define mirror-image pockets 34, 36 positioned opposite one another on opposite sides of a central vertical plane 38.

Figure 5:
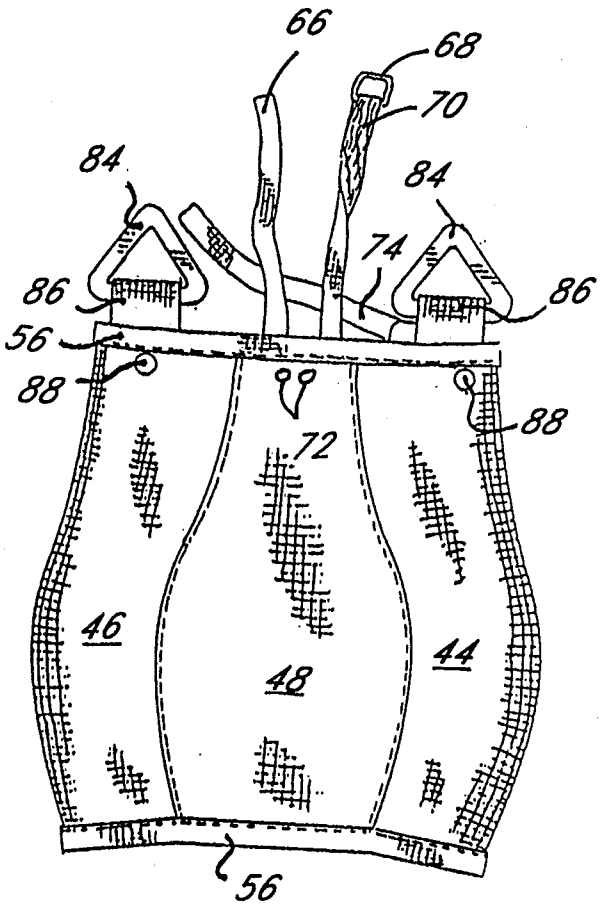
FIG. 5 is a rear elevational view of the upper cover of FIG. 4.

In an exemplary embodiment illustrated by FIGS. 4 and 5, the halves 30, 32 of the upper cover 16 are formed by a pair of front panels 40, 42, a pair of central panels 44, 46 and a rear panel 48 which are sewed together along common edges. Each front panel 40, 42 has a shape complementary to that of the profile of the ski toe binding 20, and preferably has a generally rectangular shape with an arcuate-shaped, convex edge 50 extending outwardly from the panel 40, 42. The rear panel 48 has a shape complimentary to a shape defined by the two front panels 40, 42 when positioned in a plane with their elongated, straight edges 52 juxtaposed. The central panels 44, 46 have a generally rectangular shape which form arcuate surfaces when sewed to the arcuate edges 50 of the front panels 40, 42 and the rear panel 48.

The panels 40, 42, 44, 46, 48 preferably are formed of a lightweight, weaved, flexible material, such as, for example, a nylon or canvas cloth. In an exemplary embodiment, the panels are desirably formed of Nylon 1000 Denier Cordura, having a water-proof or water-resistant coating applied to one side. The desired Nylon Cordura is commercially available from DuPont. It is also contemplated that a layer of padding material could be sewed into the upper cover 16 to further protect the toe bindings 20.

As FIGS. 4 and 5 illustrate, a border 56 preferably edges the outer edges of the panels 40, 42, 44, 46, 48 after the panels are sewed together. The border 56 preferably extends around the periphery of the upper cover 16, finishing the edges of the panels for a neat appearance and preventing the edges of the panels from fraying and ripping. The border 56 preferably comprises a nylon binding or tape folded in half with the outer edges of the panels positioned in the fold of the nylon binding. Positioned accordingly, the border 56 is sewed onto the panels. In an exemplary embodiment, a 0.75 inch (1.9 cm) wide nylon binding is used to edge the panels.

FIG. 4 illustrates a fastening means 58 for quickly and easily securing the upper cover 16 to the skis 12 after a skier positions the upper cover 16 around the toe bindings 20. The fastening means 58 is preferably positioned proximate to the elongated, straight edges 52 of the front panels 40, 42. In an exemplary embodiment, the fastener means 58 comprises a hook portion 60 and a loop portion 62 of a hook-and-loop fastener, such as VELCRO® available commercially, which are disposed along the elongated, straight edges 52 of the front panels 40, 42 on opposing surfaces; the front panels 40, 42 preferably overlap when positioned around the toe bindings 20 so that the hook portion 60 and the loop portion 62 of the VELCRO® strip can interconnect.

Although FIG. 4 illustrates the fastener means 58 as a VELCRO® strip, it is understood that other fastener means, such as, for example, zippers, snaps, and the like can be used as well. Moreover, the panels could be sewed together in a sleeve-like fashion and sized to slip over the toe bindings 20 with fastener means, such as, for example, elastic bands or draw strings securing the upper cover 16 to the skis 12 and over the toe bindings 20.

FIGS. 4 and 5 also illustrate that the upper cover 16 may include a draw strap 64 used to pull the bottom surfaces 22 of the skis 12 together. Most current skis 12 have a slight bow and, thus, when the skier juxtaposes the ski bottoms 22, the bowed bottoms 22 form a gap most prominent proximate to the toe bindings 20. The draw strap 64 pulls the ski bottoms 22 flush against each other such that the upper cover 16 can tightly surround the skis 12 with the bottom surfaces 22 juxtaposed.

The draw strap 64 preferably is nylon and comprises a section of VELCRO® hook portion 66 positioned at one end and a plastic ring 68 sewed to the other end, as known in the art. The strap 64 further includes a section of VELCRO® loop portion 70 positioned between its ends. The draw strap 64 is preferably attached to the rear panel 48 of the upper cover 16 at its center via a pair of rivets 72. In use, the skier wraps the VELCRO® end 66 of the strap 64 around the portion of the skis 12 positioned in the upper cover 16, loops the end 66 through the ring 68, and folds the strap 64 over itself to engage the hook and loop portions 66, 70 of the VELCRO® fastener.

FIG. 4 also illustrates an exterior pole retention strap 74 and a cooperatively positioned ring 76 used to lash a skier's ski poles to the exterior of the upper cover 16. The retention strap 74 extends for the cover 16, preferably being attached at the seem between a front panel 42 and a central panel 46 proximate to a top end 78 of the upper cover 16. In an exemplary embodiment, the retention strap 74 comprises a 1.5 inch (3.8 centimeter) wide nylon webbing having a length of approximately 6.0 inches (15.3 cm).

A looped segment of webbing 80 is sewed between the opposing front panel 40 and central panel 44 with the ring 76 inserted though the loop 80 to secure the ring 76 to the upper cover 16. In this cooperative position, the skier can insert the strap 74 though the ring 76 to lash the poles to the cover 16. The ring 76 desirably has an endless half-circle configuration comprised of a durable plastic material, such as the type of ring commercially available from National Molding, Inc.

The pole retention strap 74 further includes a fastener 82 to secure the strap 74 in place after being threaded through the ring 76. Although FIG. 4 illustrates the fastener 82 as comprising cooperating hook and loop sections of a VELCRO® strip sewed on the retention strap 74, other fasteners, such as, for example, snaps, ties and the like can also be used.

In addition, it is contemplated other retainer mechanisms could be used as well to secure the ski poles to the carrying device 10. For instance, the upper cover 16 could include at least one hook attached to the exterior of the upper cover which either interacts with the ski pole handles or interconnects with the ski poles 14. In connection with the latter hook arrangement, the ski poles 14 could snap into the structure of the hook. Alternatively, the upper cover 16 could be formed to hold the poles within the cover, thus eliminating the need for an exterior pole retaining mechanism.

FIGS. 4 and 5 further illustrates a pair of support rings 84 used to couple the carrying straps 26 to the upper cover 16. A pair of looped webbing segments 86 are sewed and/or attached by rivets 88 to the central panels 44, 46 with a support ring 84 positioned between the fold of the webbing segment 86 in a manner well known in the art. Each ring 84 desirably extends above the top end of the upper cover and preferably is positioned completely above the top end 78 to allow the ring 84 to rotate about a section of the ring positioned in the fold of the webbing 86 without the ring 84 binding against the central panel 44, 46.

In an exemplary embodiment as illustrated by FIGS. 4 and 5, the support rings 84 have generally triangular shapes. However, those skilled in the art will appreciate that other shape rings can also be used. The triangular rings preferably are 1.0 inch (2.5 cm) plastic triangular rings commercially available for Nexxus or for National Molding, Inc.

Lower Cover

Figure 6:
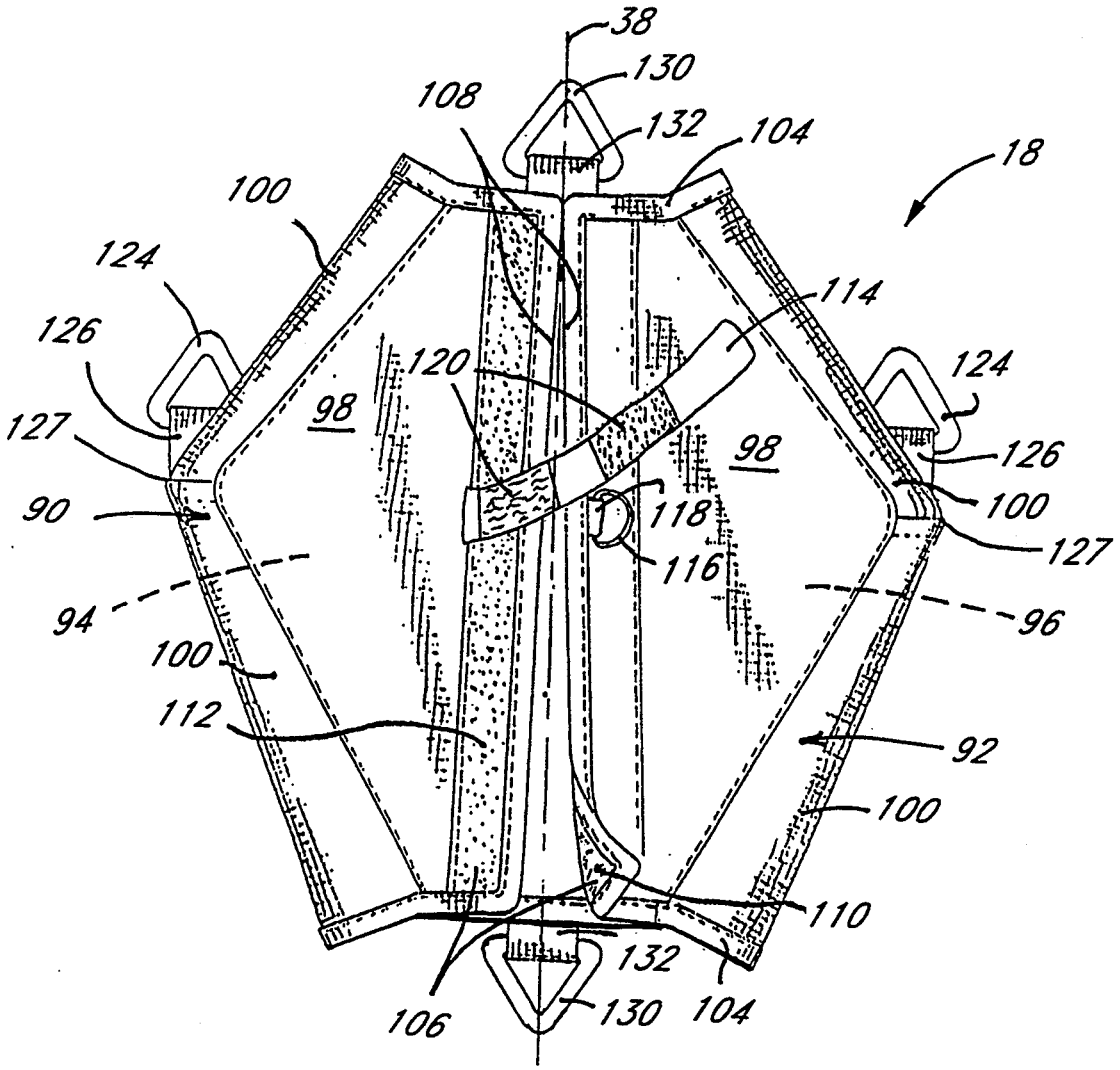
FIG. 6 is a front elevational view of a lower cover of the carrying device of FIG. 1.

FIG. 6 illustrates the lower cover 18 from a front side elevational view. The lower cover 18 is formed between a pair of mirror-image halves 90, 92, each of which define a pocket 94, 96 of sufficient size to receive a conventional heel binding 24 of the ski 12 to which the skier attaches the lower cover 18. However, those skill in the art could readily customize the pockets 94, 96 defined by the lower cover 18 for any size bindings, such as, for example, larger ski racing bindings. The halves 90, 92 are desirably coupled together in a position placing the pockets 94, 96 in opposition. That is, the two halves 90, 92 define mirror-image pockets 94, 96 positioned opposite one another on opposite sides of the central vertical plane 38.

Figure 7:
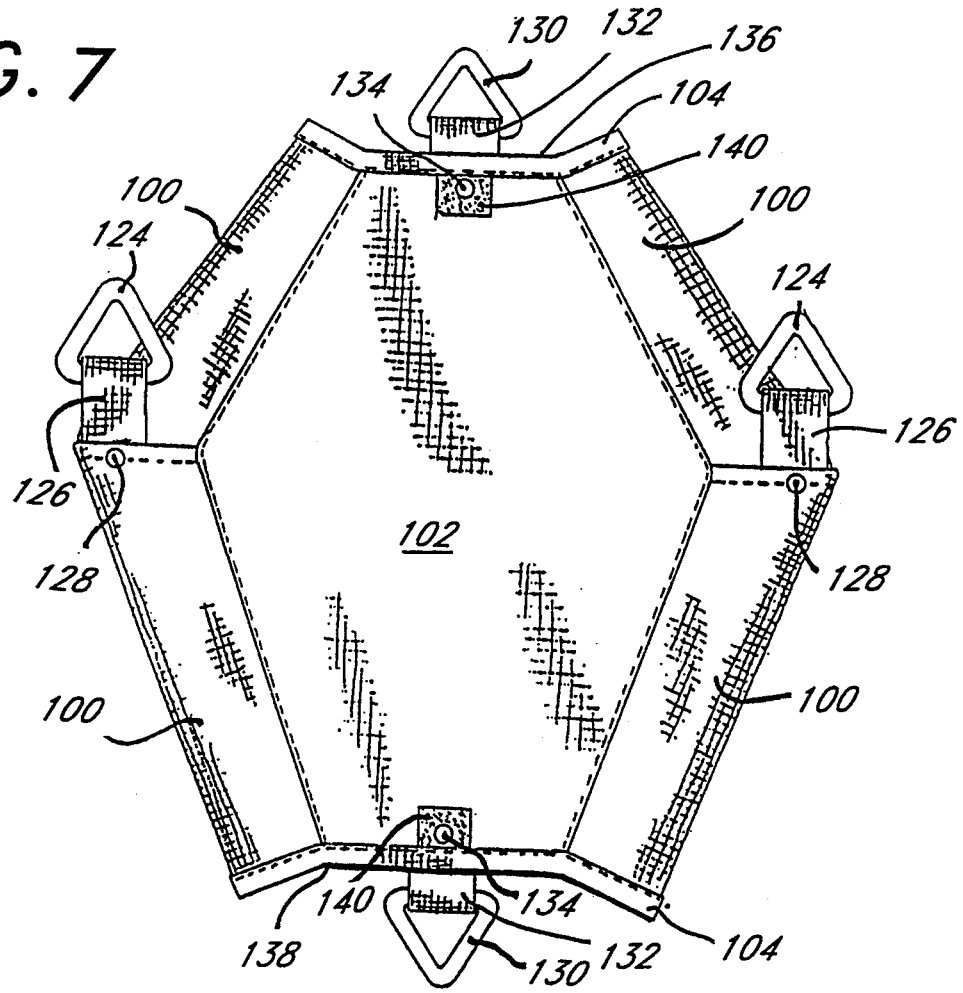
FIG. 7 is a rear elevational view of the lower cover of FIG. 6.

In an exemplary embodiment illustrated by FIGS. 6 and 7, the halves 90, 92 of the lower cover 18 are formed by a pair of front panels 98, four central panels 100 and a rear panel 102 which are sewed together along common edges. Each front panel 98 has a shape complementary to that of the profile of the ski heel binding 24, and preferably has a generally triangular shape. The rear panel 102 has generally a diamond shape of a size generally equal to that defined by the two front panels 98 when positioned in a plane with their long edges juxtaposed. Each central panel 100 has a generally rectangular shape which extends between the rear panel 102 and the front panel 98.

The panels 98, 100, 102 of the lower cover 18 preferably are also formed of a lightweight, weaved, flexible material, such as, for example, a nylon or canvas cloth. In an exemplary embodiment, the panels 98, 100, 102 are desirably formed of Nylon 1000 Denier Cordura, having a water-proof or water-resistant coating applied to one side. The desired Nylon Cordura is commercially available from DuPont. It is also contemplated that a layer of padding material could be sewed into the lower cover 18 to further protect the heel bindings 24.

As FIGS. 6 and 7 illustrate, a border 104 preferably edges the outer edges of the lower cover 18 after the panels 98, 100, 102 are sewed together. The border extends around the periphery of the lower cover 18, finishing the edges of the panels 98, 100, 102 for a neat appearance and preventing the edges of the panels 98, 100, 102 from fraying or from ripping. The border 104 preferably comprises a nylon binding or tape folded in half with the outer edges of the panels 98, 100, 102 positioned in the fold of the nylon binding. Positioned accordingly, the border 104 is sewed onto the panels 98, 100, 102. In an exemplary embodiment, a 0.75 inch (1.9 cm) wide nylon binding is used to edge the panels.

FIG. 6 illustrates a fastening means 106 for quickly and easily securing the lower cover 18 to the skis 12 after a skier positions the lower cover 18 around the heel bindings 24. The fastening means 106 is preferably positioned proximate to the elongated edges 108 of the front panels 98. In an exemplary embodiment, the fastener means 106 comprises a hook portion 110 and a loop portion 112 of a hook-and-loop fastener 106, such as VELCRO ® available commercially, and is disposed along the elongated edges 108 of the front panels 98 on opposing surfaces; the front panels 98 preferably overlap when positioned around the heel bindings 24 so that the hook portion 110 and the loop portion 106 of the VELCRO ® strip 106 can interconnect.

Again, it is understood that although FIG. 6 illustrates the fastener means 106 as a VELCRO ® strip, other fastener means, such as, for example, zippers, snaps, and the like can be used as well. Moreover, the panels 98, 100, 102 could be sewed together in a sleeve-like fashion and sized to slip over the heel bindings 24 with fastener means, such as, for example, elastic bands or draw strings securing the lower cover 18 to the skis 12 and over the heel bindings 24.

FIG. 6 also illustrates an exterior pole retention strap 114 and a cooperatively positioned ring 116 used to lash a skier's poles 14 to the exterior of the lower cover 18. The retention strap 114 extends for the cover 18, preferably being attached proximate to the elongated edge 108 of the front panel 98 at about the center of the of the lower cover 18. In an exemplary embodiment, the retention strap 114 comprises a 1.5 inch (3.8 centimeter) wide nylon webbing having a length of approximately 5.0 inches (12.7 cm).

A looped webbing segment 118 is sewed onto the other front panel 98 directly opposite the retention strap 114 with the ring 116 inserted though the loop 118 to secure the ring 116 to the lower cover 18. In this cooperative position, the skier can insert the strap 114 though the ring 116 to lash the poles 14 to the lower cover 18. The ring 116 desirably has an endless half-circle configuration comprised of a durable plastic material, such as the type of ring commercially available from National Molding, Inc.

The pole retention strap 114 further includes a fastener 120 to secure the strap 114 in place after being threaded through the ring 116. Although FIG. 6 illustrates the fastener 120 as comprising cooperating hook and loop sections of a VELCRO ® strip sewed onto the retention strap 114, other fasteners, such as, for example, snaps, ties and the like can also be used.

Again, it is contemplated other retainer mechanisms could be used as well to secure the ski poles 14 to the carrying device 10, such as, for example, the hooks as discussed above. Alternatively, the lower cover 18 could be formed to hold the poles 14 within the cover 18, thus eliminating the need for an exterior pole retaining mechanism.

FIGS. 6 and 7 further illustrates a first pair of support rings 124 used to couple the carrying straps 26 to the lower cover 18. The supporting rings 124 are positioned at the transverse corners 127 of the generally diamond-shaped lower cover 18. Two looped webbing segments 126 are sewed and/or attached by rivets 128 to the central panels 100 with a support ring 124 positioned between the fold of each webbing segment 126 in a manner well known in the art.

The lower cover 18 further includes a second pair of support rings 130 for securing a bundled carrying device 10 around the skier's waist, as discussed below. A second pair of looped webbing segments 132 are sewed and/or attached by rivets 134 to the rear panel 102 at an upper edge 136 and a lower edge 138. Each support ring 130 is positioned between the fold of one webbing segment 132, thereby attaching the support ring 130 to the lower cover 18. Each support ring 130 attached to the second webbing segments 132 desirably extends away from either the upper edge 136 and the lower edge 138, and preferably is positioned completely beyond either the upper edge 136 and lower edge 138 to allow the ring 130 to rotate about a section of the ring 130 positioned in the fold of the webbing segment 132 without the ring 130 binding against the rear panel 102.

In an exemplary embodiment as illustrated by FIGS. 6 and 7, the support rings 124, 130 have generally triangular shapes. However, those skilled in the art will appreciate that other rings shapes can also be used. The triangular rings 124, 130 preferably are 1.0 inch (2.5 cm) plastic triangular rings commercially available for Nexxus or for National Molding, Inc.

As FIG. 7 illustrates, the lower cover 18 further includes a pair of VELCRO ® loop portion patches 140 sewed onto the rear panel 102 adjacent the upper and lower edges 136, 138 of the rear panel 102. As will be discussed in detail below, the VELCRO ® patches 140 cooperate with the VELCRO ® hoop portion 110 attached to the elongated edge 108 of the front panel 98, as will be discussed in detail below.

Carrying Straps

Figure 8:
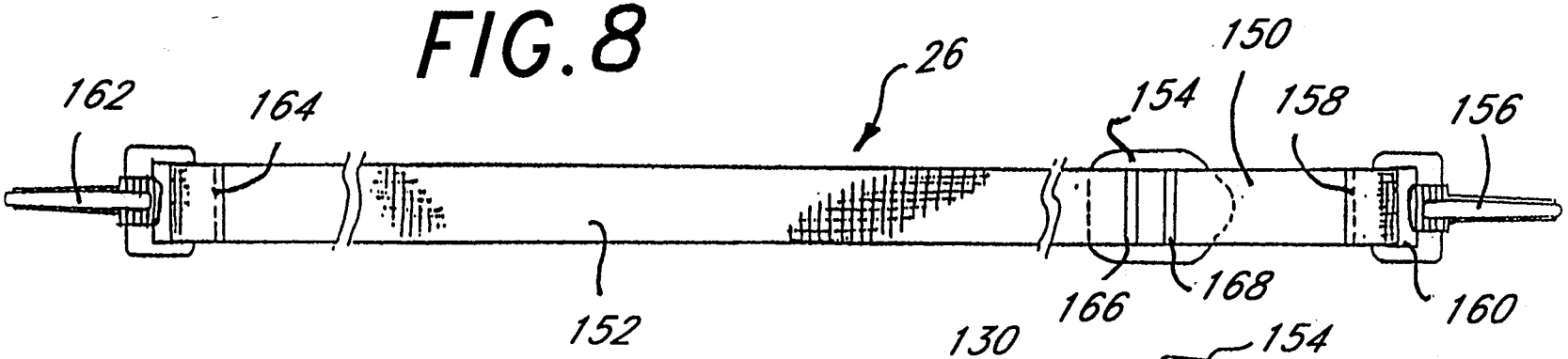
FIG. 8 is a fragmentary elevational view of a strap of the carrying device of FIG. 1.

FIG. 8 illustrates the carrying strap 26 comprising a first webbing strip 150 and a second webbing strip 152 connected together by a tabular 154. The tabular 154 preferably is a plastic tabular of the type commercially available from National Molding, Inc. The tabular 154 allows the skier to adjust the length of the carrying straps 26, as discussed below.

A snap hook 156 is attached at one end of the first webbing strip 150 by threading the strip end 158 through an aperture 160 of the hook 156, folding the webbing strip 150 upon itself, and sewing the end 158 to the webbing strip 150, as known in the art. Consequently, the snap hook 156 can rotate about the loop formed in the webbing strip 150. The opposite end of the first webbing strip 150 is attached to the tabular 154 in a similar manner.

A second snap hook 162 is attached to the one end 164 of the second webbing strip 152 in a manner similar to that described above. The second end of the second webbing strip 152 loops through a pair of apertures 166, 168 defined by the tabular 154 to secure the second webbing strip 152 to the tabular 154, as known in the art.

In an exemplary embodiment, the snap hooks 156, 162 comprise swivel snap hooks of the type commercially available from National Molding, Inc., to allow the straps to rotate relative to the covers 16, 18, and to reduce binding of the carrying straps 26. The webbing 150, 152 preferably comprises 1.5 inch (3.8 cm) wide nylon webbing.

Method of Using Carrying Device

When using the ski carrying device 10, as illustrated either by FIG. 2 or by FIG. 3, the skier places the bottoms 22 of the skis 12 together in a juxtaposed position. The skier then places the upper cover 16 around the toe bindings 20 and draws the skies together using the drawing strap 64. That is, the skier places the skis against the rear panel 48 of the upper cover 16, wraps the end of the draw strap 64 around the skis 12 and threads the draw strap 64 through the ring 68. The skier then secures the draw strap 64 in this position by pressing the cooperating VELCRO® strips together. After drawing the skis 12 together, the skier snugly pulls the upper cover 16 around the toe bindings 20, placing one toe binding 20 in each pocket 34, 36 of the upper cover 16. The skier subsequently presses the overlapping front panels 40, 42 together to engage the cooperating VELCRO® strips 60, 62 to secure the upper cover 16 over the toe bindings 20 and onto the skis 12.

The skier also places the lower cover 18 over heel bindings 24 by wrapping the lower cover 18 around the heel bindings 24. The skier adjusts the lower cover 18 to position one heel binding 24 in each pocket 94, 96 of the lower cover 18 and pulls the lower cover 18 taut to a position where the front covers 98 overlap. The skier then presses together the overlapping front covers 98 to engage the cooperating VELCRO® strips 110, 112 and, thus, secures the lower cover 18 over the heel bindings 24 and onto the skis 12.

After placing the covers 16, 18 on the skis 12, the skier may attach the ski poles 14 to the carrying device 10. The skier first places the ski poles 14 together. Positioning the poles 14 parallel to and against the skis 12, the skier wraps the pole retention straps 74, 114 around the poles 14, threads the straps through the corresponding rings 76, 116, and presses the VELCRO® section 82, 120 of the retainer straps 74, 114 together to hold the straps 74, 114 in place.

The skier also connects the carrying straps 26 to the covers 16, 18. Specifically, the skier snaps the snap hooks 156 attached to first webbing strips 150 onto the triangular rings 84 of the upper cover 16 and snaps the opposite snap hooks 162 to the triangular rings 124 positioned at the transverse corners 127 of the lower cover 18. Attached accordingly, each strap 26 extends between the upper cover 16 and the lower cover 18.

As FIG. 2 illustrates, the skier pulls each strap 26 over a shoulder to position the skis 12 against the skier's back. The skier can adjust the position of the skis and the looseness of the straps 26 via the tabulars 154 located proximate the skier's chest when the skier wears the carrying device 10. The skier can tighten the straps 26 by pulling down on the second webbing strip 152 threaded through the tabular 154, or can loosen the straps 26 by pushing up on the tabular 154, as known in the art.

Alternatively, as illustrated in FIG. 3, the skier can wear the carrying device 10 in a fashion skewing the skis 12 at a slight angle so that the ends of the skis 12 do not interfere with the skier as he or she walks. For the skier to wear the carrying device 10 in this posture, the skier attaches one carrying strap 26 between the upper cover 16 and the lower cover 18 such that the strap 26 extends diagonally across the skier's body. The skier wraps the other strap 26 around his or her waist. In this position, the second strap 26 attaches to the rings 124 positioned at the transverse corners 127 of the lower cover 18. The second strap 26 positioned around the skier's waist also enables the skier to wear a carrying case 170 to store coins, a wallet, sunglasses or the like. The skier can adjust each strap 26 as described above. With either arrangement, however, the carrying device 10 retains the skis 12 and ski poles 14 in a generally vertical position on the skier's body.

The skier using the carrying device 10 easily transports his or her ski equipment without using his or her hands and in an unobtrusive manner. The skier carrying the skis 12 on his or her back is less likely to strike another person or other objects with the skis 12. Moreover, the skier can keep the skis 12 on his or her back when buying a lift ticket or when walking through crowded area at the ski resort, thus reducing the number of times the skier sets the ski 12 against a wall or on the ground. Consequently, the skier is less likely to damage the skis' edges and bottoms and the skis' bindings.

Figure 9:
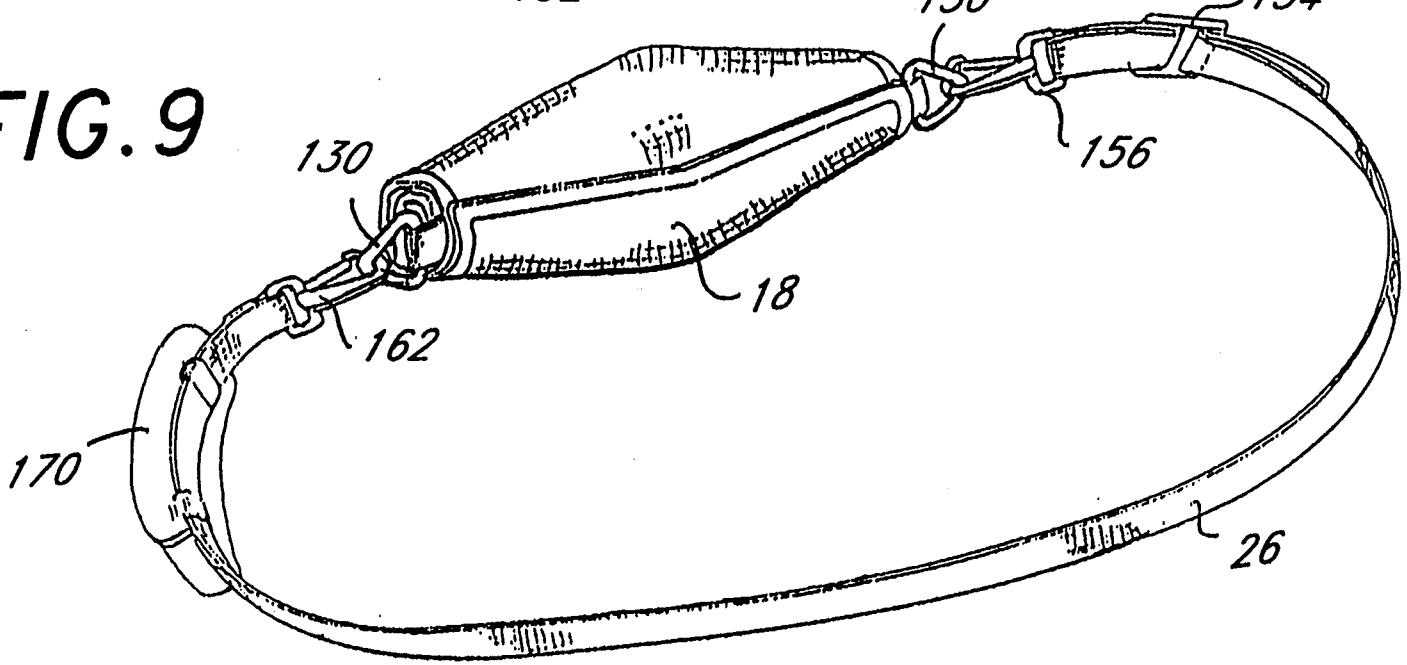
FIG. 9 is a perspective view of the ski carrying device of FIG. 1 converted to a hip pocket.

FIG. 9 illustrates that the skier may quickly and easily convert the carrying device 10 into a hip pocket which the skier may wear around his or her waist. To convert the carrying device 10 to a hip pocket, the skier removes the covers 16, 18 from the skis 12 and preferably removes the straps 26 from the covers 16, 18 by disconnecting the snap hooks 156, 162 from the triangle rings 84, 124. The skier then places the transverse corner 127 of the lower cover 18, proximate to the front panel 98 having the looped VELCRO® portion 112, into the opposing pocket 96 of the lower cover 18. In this manner, the skier completely folds the first half 90 of the lower cover 18 into the second half 92 to form a generally triangular-shaped pouch.

The skier then places one strap 26 inside the upper cover 16 and rolls the upper cover 16 into a small bundle. The skier places the rolled cover 16 into the pouch formed by the lower cover 18. Preferably, the pouch has a sufficient size to receive other articles, such as, for example, sunglasses, maps, sun-block, lip gloss or the like, in addition to the upper cover 16 and strap 26.

An elongated edge 108 of the lower cover front panel 98 flaps over the pouch to cover its contents. The hooked VELCRO® portion 110 of the elongated edge 108 engages the looped VELCRO® patches 140 positioned of the exterior of the rear panel 102 to secure the front panel edge 108 over the pouch opening. The triangular rings 130 positioned at the upper and lower edges 136, 138 of the rear panel 102 extend outwardly with the lower cover 18 compacted accordingly. The skier then attaches the second strap 26 to one of the exposed rings 130, wraps the strap 26 around his or her waist, and attaches the other end of the strap 26 to the other exposed triangular ring 130. The skier can tighten or loosen the strap by using the tabular 154, as described above.

Thus, the skier may easily convert the carrying device 10 to a hip pocket and may wear the hip pocket around his or her waist while skiing. The carrying device 10 need not be stored in a locker or locked to a post when not being used. Moreover, the carrying device 10, strapped to the skier's waist, is readily available for use at any location on the ski slope or in the skiing resort.

In an exemplary embodiment, the carrying device 10 folds into a triangular shaped pocket with a flat central panel 100 exposed when worn by the skier. The skier may attach identifying indicia, such as embroidered letters, to the flat panel 100 to distinguish the skier's carrying device 10 from like carrying devices 10 owned by other skiers.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A ski carrying device for carrying a pair of skis on a skier's body, each ski having a toe binding and a heel binding, said ski carrying device comprising:

an upper cover comprising a first upper pocket formed by a first portion of an upper rear panel and a first upper front panel which is attached to said rear panel by a first upper central panel, and an opposing second upper pocket formed by a second portion of said upper rear panel and a second upper front panel which is attached to said rear panel by a second upper central panel, said first upper pocket being sized to receive one of the toe bindings of the skis and said second upper pocket being sized to receive the other toe binding of the skis each pocket being configured to snugly fit about a rear end of the corresponding toe binding, said upper cover further comprising a fastener to secure said upper cover to the skis;

a lower cover comprising a first lower pocket formed by a first portion of a lower rear panel and a first lower front panel which is attached to said lower rear panel by a first lower central panel, and an opposing second lower pocket formed by a second portion of said lower rear panel and a second lower front panel which is attached to said lower rear panel by a second lower central panel, said first lower pocket being configured to receive one of the heel bindings of the skis and said second lower pocket being sized to receive the other heel binding of the skies, each pocket being configured to snugly fit about a rear end of the corresponding heel binding, said lower cover further comprising a fastener to secure said lower cover to the skis; and a first strap and a second strap, each strap connecting to and extending between said upper cover and said lower cover.

2. The ski carrying device of claim 1, wherein said fasteners of said upper cover and said lower cover are selected from a group of quick engaging fasteners consisting of hook-and-loop fasteners, zippers, snaps, and elastic bands.

3. The ski carrying device of claim 1, wherein said upper cover and said lower cover are each formed of a lightweight, flexible material.

4. The ski carrying device of claim 3, wherein said flexible material comprises a nylon cloth.

5. The ski carrying device of claim 1, wherein said upper cover comprises a pair of edges positioned proximate to said pockets, each edge being formed with one of said front panels, said edges further being positioned to overlay each other with said upper cover surrounding the toe bindings with the bottoms of the skis juxtaposed, and said fastener of said upper cover being position to attaches said edges together.

6. The ski carrying device of claim 1, wherein at least one of said straps is removably connected to said upper cover and to said lower cover.

7. The ski carrying device of claim 6, wherein one of said straps connects to said upper cover and to said lower cover via a snap hook and ring interconnection.

8. The ski carrying device of claim 7, wherein said snap hook swivels.

9. The ski carrying device of claim 1, wherein said lower cover is configured to fold into a pouch having a sufficient size to receive said upper cover, said upper and lower covers forming a compact bundle with said upper cover inserted into said pouch formed by said lower cover.

10. The ski carrying device of claim 9, wherein said strap is removably connected to said upper cover and to said lower cover such that said strap functions as a shoulder strap with said strap connected to said upper and to lower covers, and functions as a waist band with said strap connected to said lower cover at both ends of the strap.

11. The ski carrying device of claim 1 additionally comprising a strap to draw and to hold said skis together with said bottoms juxtaposed.

12. The ski carrying device of claim 1 additionally comprising a retention mechanism to hold and secure a pair of ski poles in a position generally parallel to the skis to which said ski carrying device is connected.

13. The ski carrying device of claim 12, wherein said retention mechanism comprises a pair of strap and ring connectors cooperatively positioned on said covers such that each strap belts across the ski poles and loops through one of said rings to secure the poles to the covers.

14. The ski carrying device of claim 1, wherein each strap includes an adjustment mechanism.

15. The ski carrying device of claim 14, wherein said strap adjustment mechanism comprises a tabular.

16. A method of carrying skis in an unobtrusive position upon a skier's body, said method comprising the steps of:

juxtaposing the bottom surfaces of the skis such that the corresponding sections of the bindings interconnect;

providing a ski carrying device of the type having an upper cover and a lower cover interconnected by a pair of straps, said upper cover including a pair of opposing pockets formed by a rear panel and pair of front panels which are each attach to said rear panel by a central panel, and said lower cover also including a pair of opposing pockets formed by a rear panel and pair of front panels which are each attach to said rear panel by a central panel, said upper and lower covers each including a fastener to secure said covers to the skis;

inserting one toe binding into one pocket of said upper cover and inserting the opposite toe binding into the opposite pocket of said upper cover;

wrapping the upper cover around the toe bindings of the skis such that the upper cover tightly fits around the rear ends of the toe bindings;

interconnecting the fastener to secure the upper cover to the skis;

inserting one heel binding into one pocket of said lower cover and inserting the opposite heel binding into the opposite pocket of said lower cover;

wrapping the lower cover around the heel binding of the skis such that the lower cover tightly fits about the rear ends of the heel bindings;

interconnecting the fastener to secure the lower cover to the skis;

attaching said pair of straps to the upper cover and to the lower cover;

positioning the straps over the skier's shoulders with the skis resting against the skier's back; and positioning the skis in a generally unobtrusive position, slightly skewed from vertical.

17. The method of claim 16 additionally comprising the steps of:

removing said ski carrying device from the skis;

inserting one side portion of said lower cover into an opposing side portion of said lower cover to compact said lower cover and form a pouch;

inserting said upper cover and one of said straps into said pouch formed by said lower cover; and positioning said lower cover pouch at the skier's waist and attaching said second strap to said compacted lower cover to secure said lower cover pouch to said skier's waist.

* * * * *